US008397407B2

(12) United States Patent
Lauer et al.

(10) Patent No.: US 8,397,407 B2
(45) **Date of Patent: *Mar. 19, 2013**

(54) GIFT CARD ASSEMBLY WITH STICKER AND ASSOCIATED METHODS

(75) Inventors: Amy Lauer, Hopkins, MN (US); John Mayhew, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 136 days.

This patent is subject to a terminal disclaimer.

(21) Appl. No.: 12/983,746

(22) Filed: Jan. 3, 2011

(65) Prior Publication Data

US 2011/0099129 A1 Apr. 28, 2011

Related U.S. Application Data

(63) Continuation of application No. 12/164,816, filed on Jun. 30, 2008, now Pat. No. 7,891,122, which is a continuation of application No. 10/804,796, filed on Mar. 18, 2004, now Pat. No. 7,409,788.

(51) Int. Cl.
*G09F 1/00* (2006.01)

(52) U.S. Cl. ..... 40/124.01; 40/594

(58) Field of Classification Search ..... 40/124.01, 40/594

See application file for complete search history.

(56) References Cited

U.S. PATENT DOCUMENTS

| | | | | |
|---|---|---|---|---|
| 1,330,089 | A | 2/1920 | Plauché | |
| 4,510,006 | A | 4/1985 | Lawson | |
| 4,670,644 | A * | 6/1987 | Grayson | 235/487 |
| 4,689,018 | A | 8/1987 | Trinity | |
| 4,778,153 | A | 10/1988 | Bachman et al. | |
| 5,102,171 | A | 4/1992 | Saetre | |
| 5,262,215 | A | 11/1993 | Shields | |
| 5,269,691 | A | 12/1993 | Waldman | |
| 5,535,536 | A | 7/1996 | Comann | |
| 5,640,447 | A | 6/1997 | Fonseca | |
| 5,667,248 | A | 9/1997 | Mayer | |
| 5,829,790 | A | 11/1998 | Phillips | |
| 5,914,158 | A | 6/1999 | McGuiness | |
| 6,361,045 | B1 | 3/2002 | Bernstein | |
| 6,413,603 | B1 | 7/2002 | Horton et al. | |
| 6,481,125 | B1 | 11/2002 | Pokrasoff | |
| 6,493,970 | B1 | 12/2002 | McCarthy et al. | |
| 6,520,543 | B1 | 2/2003 | Hoar | |
| 6,589,624 | B1 | 7/2003 | Lee | |
| 6,666,378 | B2 | 12/2003 | Davila et al. | |
| 6,682,099 | B1 | 1/2004 | Laurash et al. | |
| 7,024,807 | B2 | 4/2006 | Street | |
| 7,392,952 | B2 * | 7/2008 | Corcoran et al. | 235/487 |
| 8,002,197 | B1 | 8/2011 | Whitaker | |
| 2002/0019776 | A1 | 2/2002 | Simipson | |
| 2002/0143697 | A1 | 10/2002 | Gotfried | |
| 2004/0249748 | A1 | 12/2004 | Schultz et al. | |
| 2005/0055858 | A1 | 3/2005 | Lee | |
| 2005/0277358 | A1 | 12/2005 | Isenberg | |
| 2006/0036492 | A1 | 2/2006 | Becker | |
| 2006/0246984 | A1 | 11/2006 | Walker et al. | |
| 2007/0044356 | A1 | 3/2007 | Riordan et al. | |
| 2007/0242595 | A1 | 10/2007 | DiCosola | |
| 2012/0223137 | A1 * | 9/2012 | Heeter | 235/380 |

OTHER PUBLICATIONS

"Book Sense Announces a Lower Minimum for Gift Cards," news.bookweb.org/graphics/podbfw/20031120.pdf, Nov. 20, 2003.

(Continued)

*Primary Examiner* — Casandra Davis
(74) *Attorney, Agent, or Firm* — Griffiths & Seaton PLLC

(57) ABSTRACT

A gift card assembly includes a support backer; a gift card formed separately from and supported by the support backer; a sticker formed separately from and supported by the support backer; and a panel formed separately from the support backer, the gift card, and the sticker. The gift card defines an activation feature configured to facilitate loading the gift card with monetary value. The sticker is releasably coupled with the panel. The panel is coupled with the support backer such that the sticker is coupled with the support backer only via the panel, and the panel fits entirely within a footprint of the support backer. Other method and product embodiments are disclosed.

21 Claims, 8 Drawing Sheets

OTHER PUBLICATIONS

"Instant-Issue Cards," http://www.tbcardworks.com/products/html.
"Loyalty Cards," http://www.tbcardworks.com/loyaltycards.html.
"Retailers Discovering Benefits of Gift Cards," http://www.retailers.com/news/retailers/03may/mr0503giftcards.html.
"Using a Sephora Gift Card," http://www.sephora.com/customer_service/csr_ controller.jhtml? csrSection=ordering& csrSub=orderGiftCard.

* cited by examiner

GIFT CARD ASSEMBLY WITH STICKER AND ASSOCIATED METHODS

CROSS-REFERENCE TO RELATED APPLICATIONS

This application is a continuation of and claims priority under 35 U.S.C. §120 to U.S. patent application Ser. No. 12/164,816, filed Jun. 30, 2008, which is a continuation of U.S. patent application Ser. No. 10/804,796, filed Mar. 18, 2004, now U.S. Pat. No. 7,409,788, issued Aug. 12, 2008, both of which are incorporated herein by reference.

BACKGROUND OF THE INVENTION

Stored value cards and other financial transaction cards come in many forms. A gift card, for example, is a type of stored value card that includes pre-loaded or selectably loaded monetary value. In one example, a customer buys a gift card having a specified value for presentation as a gift to another person. In another example, a customer is offered a gift card as an incentive to make a purchase. A gift card, like other stored value cards, can be "recharged" or "reloaded" at the direction of the bearer. The balance associated with the card declines as the card is used, encouraging repeat visits to the retailer or other provider issuing the card. Additionally, the card generally remains in the user's purse or wallet, serving as an advertisement or reminder to revisit the associated retailer. Gift cards provide a number of advantages, to both the customer and the retailer.

SUMMARY OF THE INVENTION

According to an embodiment of the invention, a gift card assembly includes a support backer; a gift card formed separately from and supported by the support backer; a sticker formed separately from and supported by the support backer; and a panel formed separately from the support backer, the gift card, and the sticker. The gift card defines an activation feature configured to facilitate loading the gift card with monetary value. The sticker is releasably coupled with the panel. The panel is coupled with the support backer such that the sticker is coupled with the support backer only via the panel, and the panel fits entirely within a footprint of the support backer. Other methods and product embodiments are disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
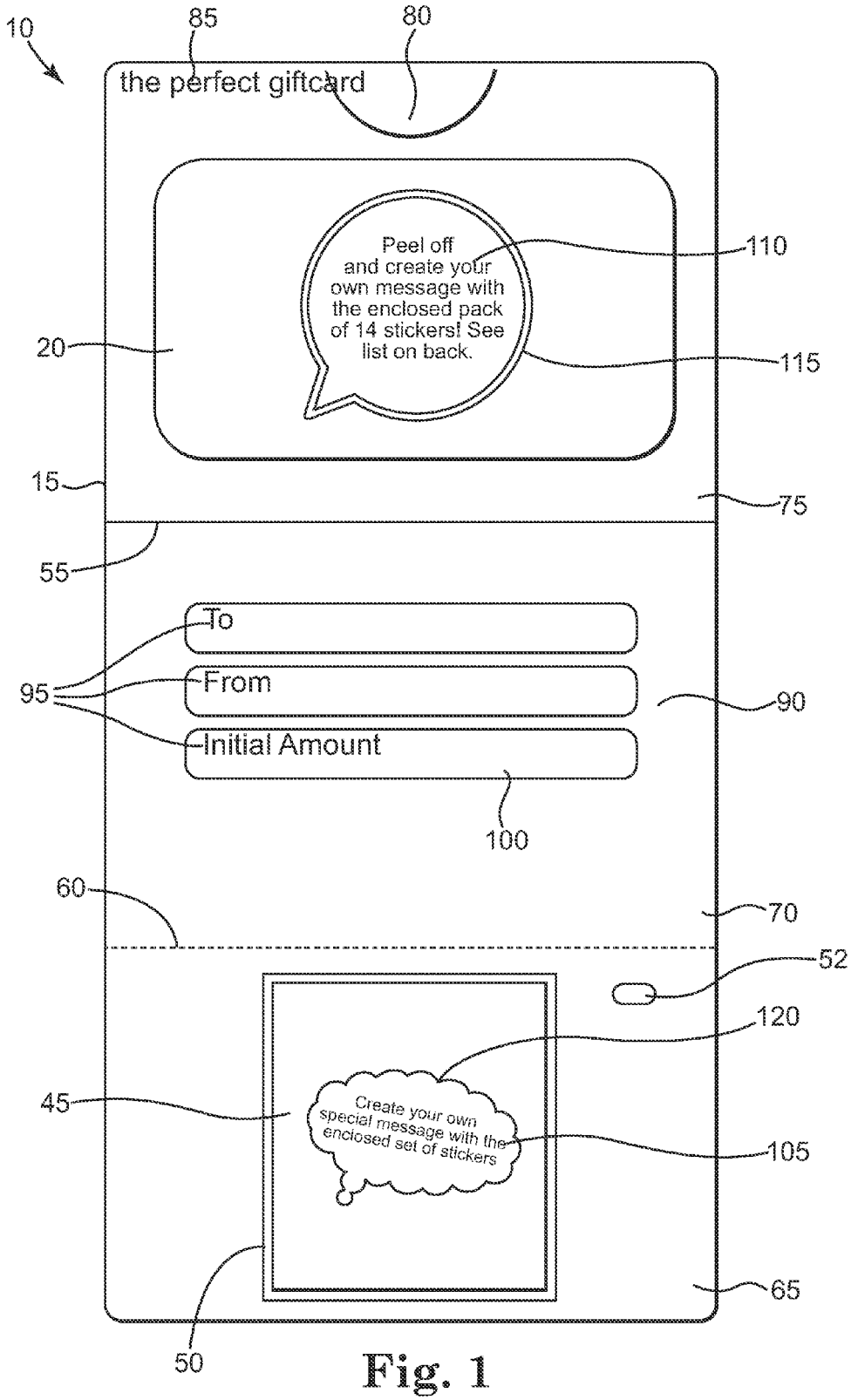
FIG. 1 is a front view of a gift card assembly, according to an embodiment of the invention.
Figure 2:
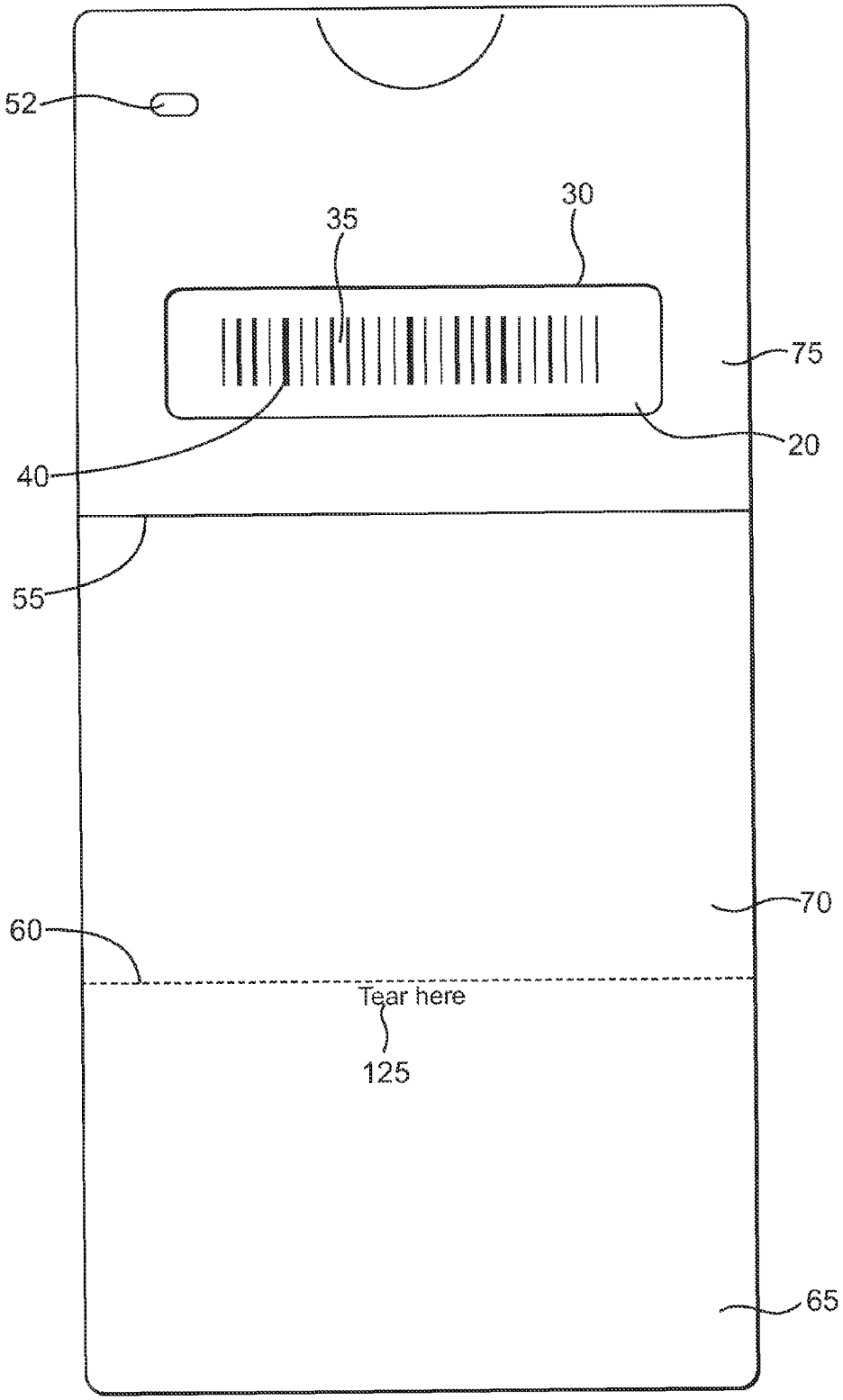
FIG. 2 is a rear view of the FIG. 1 assembly.
Figure 3:
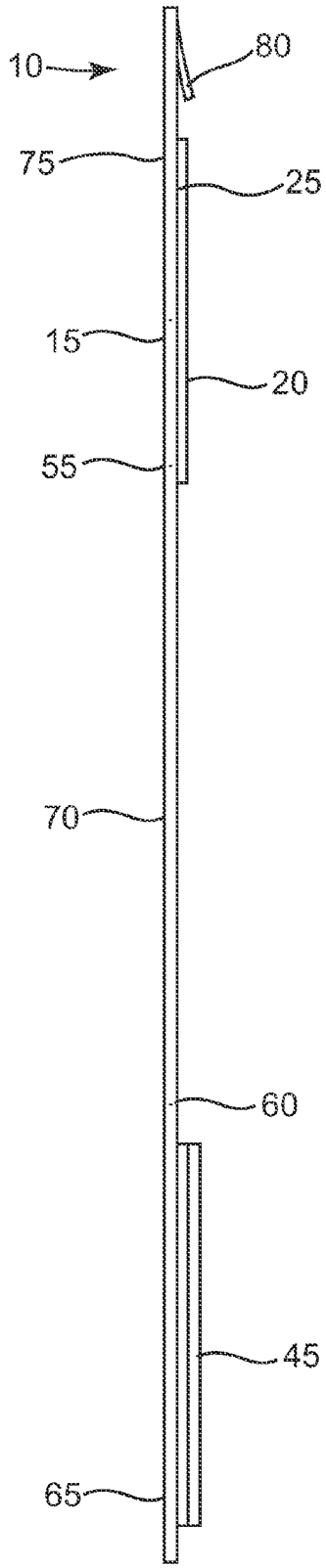
FIG. 3 is a side view of the FIG. 1 assembly.

Referring first to FIGS. 1-3, financial transaction card assembly or package 10 includes substrate 15. Substrate 15, which also may be called a backing, comprises a single layer or multiple layers of paper or plastic material, for example, generally in the form of a relatively stiff but bendable/flexible card. Other materials are also contemplated.

Substrate 15 supports stored value card or other financial transaction card 20. Card 20 is, for example, a card used by a merchant to issue a spending credit to a customer. The merchant provides the card in exchange for money received, merchandise returned or other consideration. The card is "loaded" with monetary value, for example a dollar value that the merchant's customer can use or give to another individual. A record of the monetary balance on the card optionally is maintained on a database, other electronic or manual record-keeping system, or, in the case of "smart" cards, for example, on a chip or other electronics or devices on the card itself.

Stored value cards and other financial transaction cards come in many forms, according to embodiments of the invention. A gift card, for example, includes pre-loaded or selectably loaded monetary value. In one example, a customer provides consideration in the amount of the card value, or is offered the gift card as an incentive to make a purchase, and then either keeps the card for use or provides the card as a gift to a recipient. The gift card, like other stored value cards, can be "recharged" or "reloaded" at the direction of the original customer, the gift recipient, or a third party. The balance associated with the card declines as the card is used, encouraging repeat visits. The card remains in the user's purse or wallet, serving as an advertisement or reminder to re-visit the associated merchant. Gift cards according to embodiments of the invention provide a number of advantages to both the customer and the merchant.

Other stored value cards according to embodiments of the invention include loyalty cards, merchandise return cards, electronic gift certificates, employee cards, frequency cards, pre-paid cards, and other types of cards associated with or representing purchasing power or monetary value, for example. Other forms of financial transaction cards according to embodiments of the invention include credit cards and debit cards.

Card 20 is releasably secured to substrate 15 by adhesive or an adherence layer represented generally at 25 in FIG. 3. Substrate 15 defines window or opening 30 for displaying activation area 35 of card 20. According to the illustrated embodiment, activation area 35 includes bar code 40. Alternatively, or additionally, activation area 35 may include a magnetic strip, a smart chip or other electronic device, a radio frequency identification device, or other identification device or indicia, such as a card number and event number. Bar code 40 or other activation-area feature optionally represents an account number or otherwise serves to link card 20 to a database or other electronic or manual storage device or system. In the case of a gift card, activation area 35 is adapted for loading of the gift card with monetary value.

Substrate 15 supports sticker booklet 45. Sticker booklet 45 is secured to substrate 15 by a readily severable plastic film 50 disposed over booklet 45 and adhered to substrate 15, according to one embodiment. Splitting film 50, for example along one or more perforation lines in film 50, allows access to booklet 45 and its contents. Film 50 also holds booklet 45 in the closed configuration illustrated in e.g. FIG. 1. Booklet 45 is alternatively secured to substrate 15 by adhesive or an adhesion layer. Additionally, substrate 15 supports adhesive 52 on one or both of the front side of substrate 15 (FIG. 1) and the rear side of substrate 15 (FIG. 2).

Substrate 15 is a tri-fold substrate defining two fold lines 55, 60. According to one embodiment, lower portion 65 of substrate 15 folds upwardly out of the page as viewed in FIG. 2 (upwardly into the page as viewed in FIG. 1) about fold line 60 to cover middle portion 70 of substrate 15. Fold line 60 also defines a detach line, for example a line of perforations, adapted to allow physical separation of lower portion 65 supporting sticker booklet 45 from a remainder of substrate 15, i.e. from middle portion 70 and upper portion 75. Lower portion 65 and middle portion 70 then together fold upwardly out of the page as viewed in FIG. 2 (upwardly into the page as viewed in FIG. 1) about fold line 55 to cover upper portion 75 of substrate 15, and more specifically, to cover window 30 and bar code 40.

Figure 4:
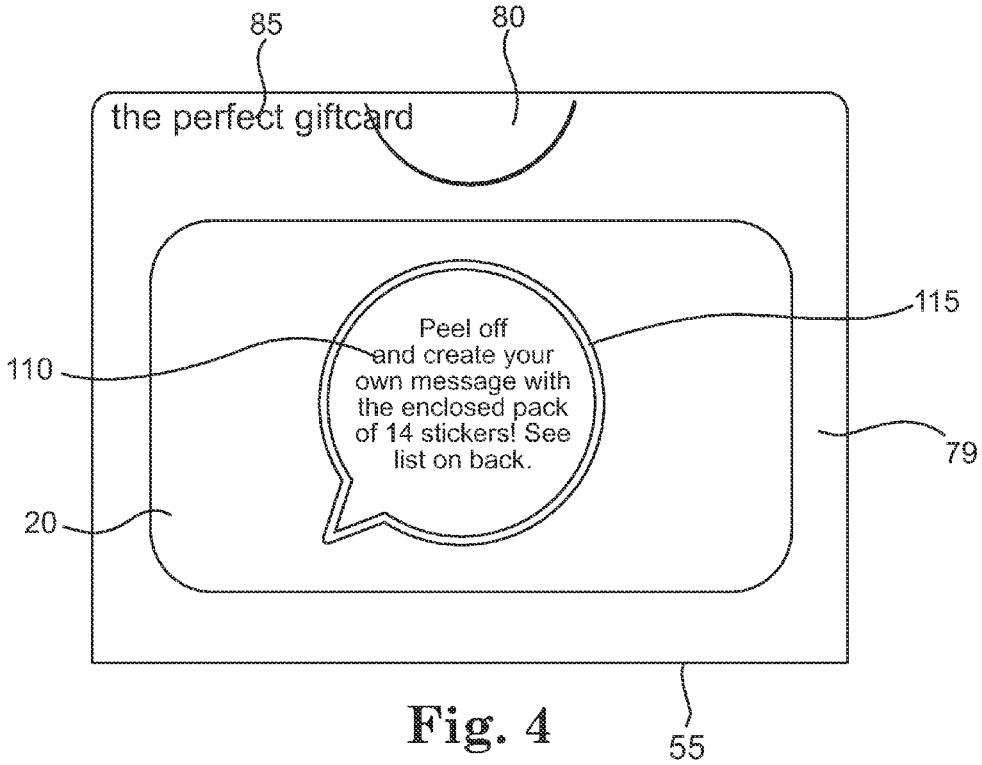
FIG. 4 is a front view of the FIG. 1 assembly in an alternative configuration, according to an embodiment of the invention.
Figure 5:
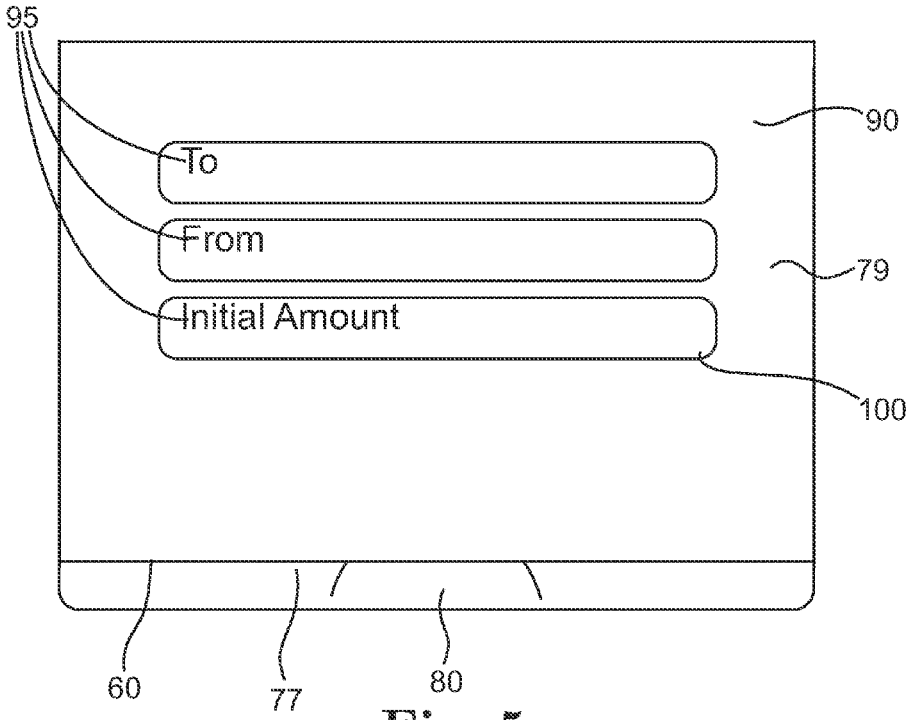
FIG. 5 is a rear view of the FIG. 4 assembly, according to an embodiment of the invention.

Folding substrate 15 in the manner described yields the folded substrate illustrated in FIG. 4, with card 20 supported on a front outer surface thereof. FIG. 5 shows the opposite side of the folded substrate illustrated in FIG. 4, rotated 180 degrees in the plane of the page.

According to one embodiment, the height of lower portion 65 is slightly less than the height of middle portion 70, such that a slight underlap area below fold line 55 is defined when lower portion 65 is folded over middle portion 70. Additionally, the height of middle portion 70 is slightly less than the height of upper portion 75, such that slight underlap area 77 is defined below fold line 60 when lower portion 65 and middle portion 70 together are folded over upper portion 75, as shown in FIG. 5.

Folded substrate 15, card 20 and sticker booklet together define compact package 79. Package 79 is releasably held in a closed position by adhesive 52, with the front of lower portion 65 (FIG. 1) being adhered to the rear of upper portion 75 of substrate 15. Substrate 15 also defines a cut forming a flap 80. If desired, and/or once adhesive 52 is released or removed, edge 60 may be tucked behind flap 80 to hold package 79 in the closed position. Package 79 displays brand or other indicia 85, e.g. "the perfect giftcard". Brand indicia or other indicia optionally is placed anywhere on substrate 15, for example in the center of middle portion 70.

Substrate 15 defines personalization area 90 (FIGS. 1 and 5), comprising indicia 95 (e.g. "From" and "To") indicating a purchaser or other provider of card 20 and a recipient of card 20, respectively, e.g. in the case where card 20 is a gift card. Indicia 95 (e.g. "Initial Amount") also may identify an initial monetary value loaded on card 20. Indicia 95 are associated with respective manual write areas 100, which allow a purchaser or other person to write information associated with indicia 95.

Assembly 10 includes other indicia, according to embodiments of the invention. Indicia 105 (e.g. "Create your own special message with the enclosed set of stickers") are provided on sticker booklet 45 and are for directing a customer or other person to customize card 20 with a selected message, e.g. a message that is, or is on, one of the stickers in sticker booklet 45, as will be described. More specifically, indicia 105 direct the customer to physically adhere a selected sticker or other message to card 20.

Figure 6:
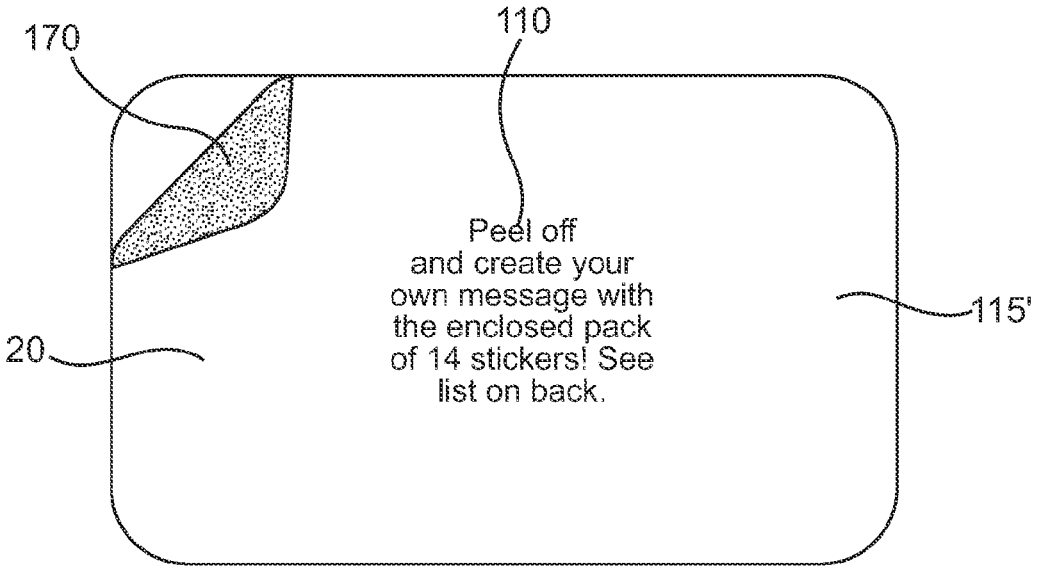
FIG. 6 is a front view of a gift card with an alternative initial label, according to an embodiment of the invention.

Additionally, indicia 110 (e.g. "Peel off and create your own message with the enclosed pack of 14 stickers! See list on back.") are provided on label, sticker or other layer 115 adhered to card 20. Indicia 110 direct the customer to "peel off" or otherwise remove label 115 from card 20 and/or to replace the removed label 115 with a selected message, e.g. a sticker from booklet 45. Label 115 covers substantially less than the entire surface of card 20, according to the FIG. 1 embodiment, and is generally in the shape of a speech bubble. According to the FIG. 6 embodiment, on the other hand, label 115' is of substantially the same size as card 20. Indicia 105 also are contained within speech bubble 120, and any of the other indicia disclosed herein are optionally contained within respective speech bubbles. Label or sticker 115 or 115' is to be removed from card 20 before applying any of the stickers from sticker booklet 45, according to embodiments of the invention.

Indicia 125 ("Tear here") indicate to a user of assembly 10 that lower portion 65 of substrate 15 can be torn away, e.g. once one or more appropriate stickers have been selected from booklet 45. Other indicia also can be provided. For example, the space below personalization area 90 may include a list of the stickers or other messages included in booklet 45, and may also indicate that additional value can always be added to card 20 if desired. Substrate 15 thus may display indicia indicating types of stickers in booklet 45, and indicating the rechargeable or reloadable nature of card 20.

Figure 7:
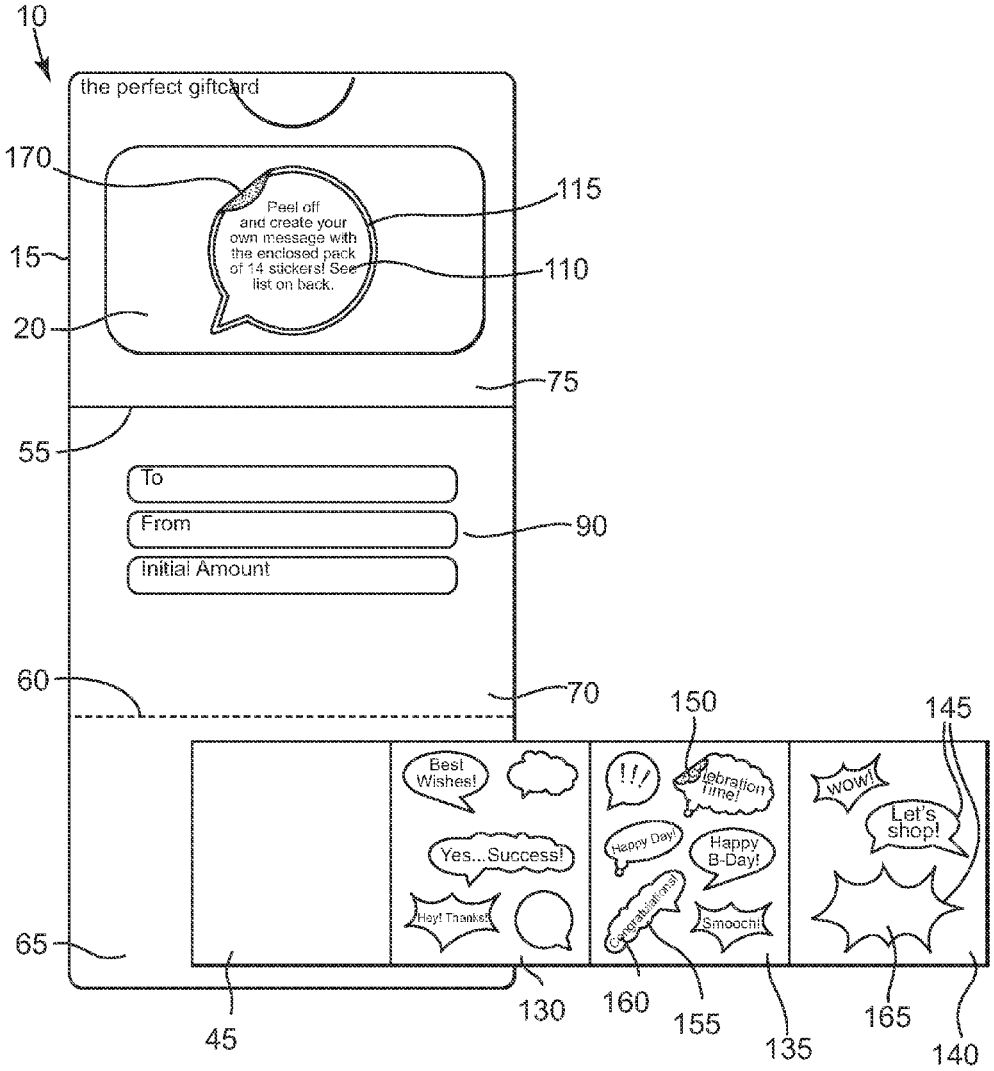
FIG. 7 is a front view of the FIG. 1 assembly with an open sticker booklet, according to an embodiment of the invention.
Figure 8:
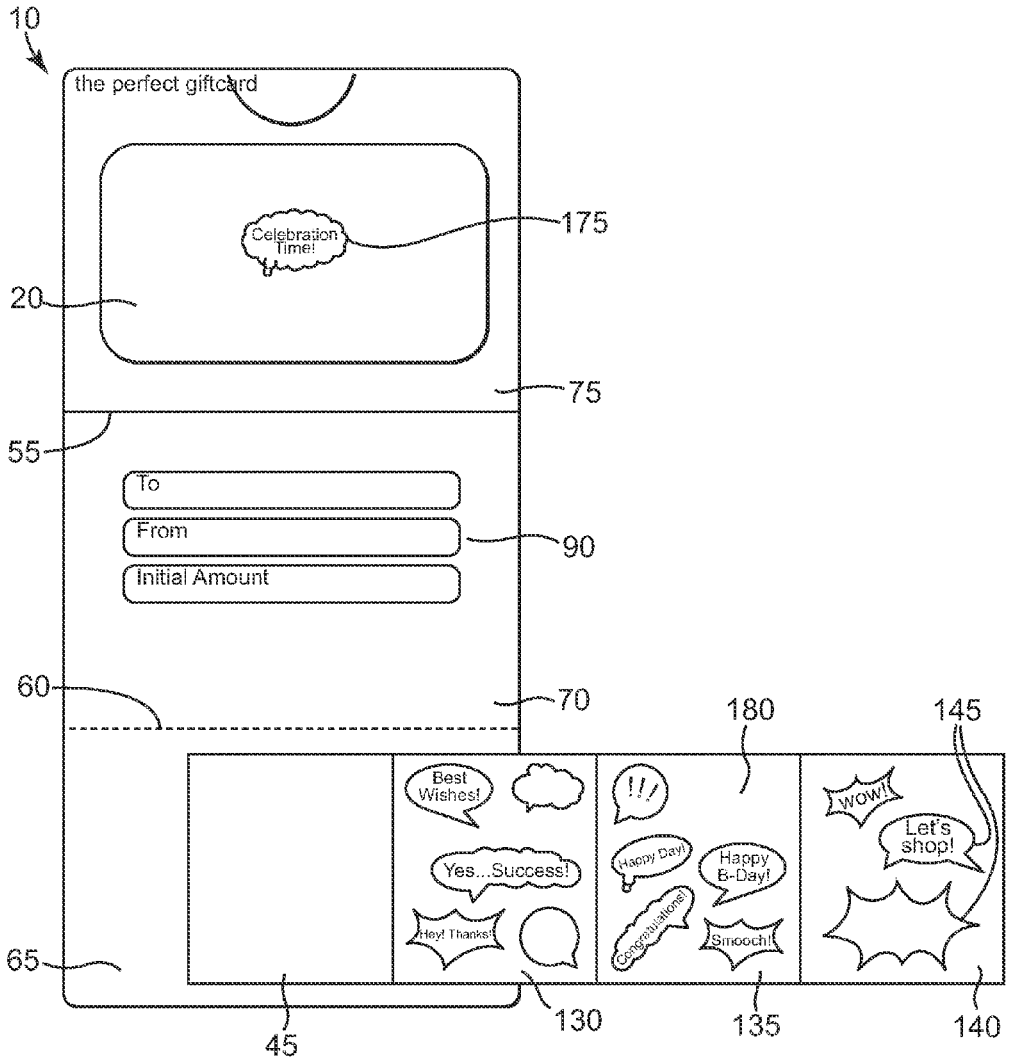
FIG. 8 is a front view of the FIG. 7 assembly with a selected sticker removed and applied, according to an embodiment of the invention.
Figure 9:
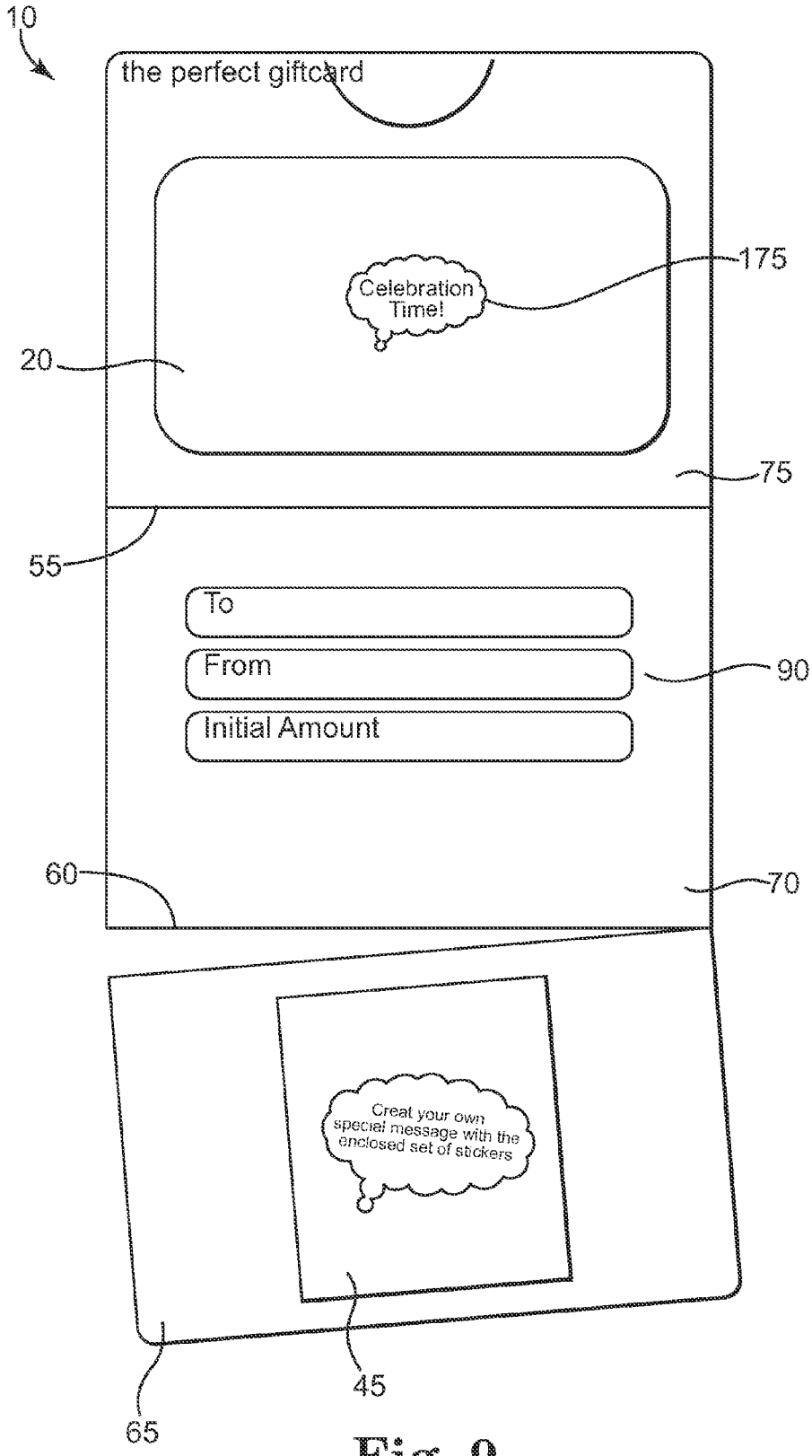
FIG. 9 is a front view of the FIG. 1 assembly with a lower portion thereof being detached, according to an embodiment of the invention.

Turning to FIGS. 7-9, FIG. 7 illustrates sticker booklet 45 in an open, unfolded configuration, with three separate panels 130, 135, 140. Although three panels are illustrated, any number of desired panels may be provided. Booklet 45 also may take other formats, e.g. a book-type format with multiple pages folding at a "spine" or center portion thereof, a fanfold-panel format, etc.

Sticker booklet 45 contains personalization messages, e.g. in the form of stickers 145 for physical application to card 20. Other forms of personalization messages are contemplated, e.g. temporary cling-type plastic decals, printing-medium transfer templates, etc. Personalization messages 145 are supported by backing or substrate 15 and each comprise adhesion surface 150, e.g. a sticky back surface. Surface 150 is adapted for releasable connection to booklet 45, and thus is adapted for releasable connection to backing 15 via booklet 45. Surface 150 also is adapted for adhesion to card 20, such that messages 145 will readily stick or otherwise adhere to card 20.

Personalization messages include a group of pre-printed stickers 155. Stickers 155 may include indicia 160 (e.g. "Congratulations!") congratulating a recipient of card 20, or may provide other messages to the recipient as illustrated in FIGS. 7-8 ("Best wishes!", "Yes . . . Success!", "Hey! Thanks!", "Happy Day!", "Happy B-Day!", "Smooch!", "Wow!", and "Let's shop!"). Blank stickers 165 allow a presenter of card 20 to manually write or otherwise provide their own congratulatory message or other message.

FIG. 7 illustrates initial sticker or label 115 being peeled back for removal from card 20. Label 115 includes adhesion surface 170 for adhering to card 20. In FIG. 8, label 115 has been removed from card 20, and a selected sticker 175 has been removed from its original position 180 on panel 135 of booklet 45. Sticker 175 is affixed to card 20 at a desired position, resulting a personalized, customized card for presentation to a recipient or for other purpose. Multiple stickers optionally may be affixed to card 20.

FIG. 9 illustrates lower portion 65 of substrate 15 being torn away along fold/tear line 60, such that portion 65 and the unused portion of sticker booklet 45 may be discarded if desired. Middle portion 70 then can be folded upwardly into the page along line 55, as viewed in FIG. 9, to create package 79 of FIGS. 4-5, without lower portion 65 and booklet 45. Edge 60 may be tucked behind flap 80 to hold package 79 in its closed position.

According to embodiments of the invention, then, assembly 10 is an example of apparatus for allowing personalization of financial transaction card 20, comprising means for presenting a group of personalization messages for application to financial transaction card 20, means for allowing removal of a selected sticker from the group of stickers, and means for allowing application of the selected sticker to financial transaction card 20, to personalize financial transaction card 20.

According to a method embodiment of the invention, a method of personalizing stored value card 20 comprises selecting sticker 175 from a group of stickers 145 associated with stored value card 20, removing selected sticker 175 from the group of stickers 145, at 180, and applying selected sticker 175 to stored value card 20, to personalize stored value card 20. The group of stickers is supported by substrate 15, and substrate 15 also supports stored value card 20. The method includes opening sticker booklet 45 to view the group of stickers 145, as shown in e.g. FIG. 7. The removing of selected sticker 175 optionally comprises peeling off selected sticker 175 from booklet 145. The method also optionally comprises removing sticker 115 from stored value card 20 before applying selected sticker 175 to stored value card 20. Stored value card 20 optionally is a gift card for presentation as a gift to a recipient, and the method further comprises selecting a sticker 145 that conveys a message related to the gift, e.g. "Congratulations!" or the like. The method also optionally includes detaching portion 65 of substrate 15 that supports the group of stickers 145. The method further optionally includes personalizing a sticker 165 by manually writing on the selected sticker. Stored value card 20 may be presented to an employee of a retail store for activation of stored value card 20, according to another method embodiment of the invention.

According to other embodiments, a method of encouraging customization of financial transaction card 20 by a customer includes displaying financial transaction card 20 to the customer, and displaying indicia 105 and/or 110, for example, directing the customer to customize financial transaction card 20 with a selected message 145/175, the message being selectable by the customer from a group of messages 145. Financial transaction card 20 is a stored value card, according to one embodiment, and the method further includes displaying the stored value card at the point-of-sale in a retail sales environment. The group of messages optionally comprises a group of stickers 145 for application to financial transaction card 20. The method also includes displaying indicia 105 and/or 110 directing the customer to physically adhere to financial transaction card 20 a selected message 175 from the group of messages 145. The method also includes displaying indicia 110 directing the customer to remove sticker or label 115 from financial transaction card 20 and to replace removed label 115 with selected message 175. The method also includes displaying substrate 15 that supports financial transaction card 20, indicia 110/115, and the group of messages 145. Financial transaction card 20 optionally is a gift card, and the method further includes displaying activation area 35 of gift card 20 for loading of gift card 20 with monetary value.

According to another embodiment, a method of making a customizable stored value card assembly 10 includes adhering customizable stored value card 20 on substrate 15, and adhering a group of messages 145 to substrate 15, at least one of the messages 145 being physically removable from the group of messages 145 for application to stored value card 20, for customizing stored value card 20. The method also includes displaying activation area 35 of card 20 through opening 30 in substrate 15, activation area 35 being adapted for loading of stored value card 20 with monetary value.

Although the invention has been described with respect to particular embodiments, such embodiments are for illustrative purposes only and should not be considered to limit the invention. Various alternatives and changes will be apparent to those of ordinary skill in the art. For example, stickers 145 may be directly adhered to e.g. lower portion 65 of substrate 15, instead of being presented in booklet 45. Other modifications and changes will be apparent to those of ordinary skill.

What is claimed is:

1. A gift card assembly, comprising:
- a support backer;
- a gift card formed separately from and supported by the support backer, the gift card defining an activation feature configured to facilitate loading the gift card with monetary value;
- a sticker formed separately from and supported by the support backer; and
- a panel formed separately from the support backer, the gift card, and the sticker, wherein:
  - the sticker is releasably coupled with the panel,
  - the panel is coupled with the support backer such that the sticker is coupled with the support backer only via the panel, and
  - the panel fits entirely within a footprint of the support backer.

2. The gift card assembly of claim 1, wherein the activation feature is a bar code.

3. The gift card assembly of claim 1, wherein the activation feature is one of a bar code, a magnetic strip, a smart chip and a radio frequency identification device.

4. The gift card assembly of claim 1, wherein the gift card is releasably adhered to the support backer.

5. The gift card assembly of claim 1, wherein the support backer is configured to fold around the gift card.

6. The gift card assembly of claim 1, wherein the sticker is configured to be applied to the gift card to personalize the gift card for a recipient, and the support backer further includes indicia instructing a bearer of the gift card to use the sticker to personalize the gift card.

7. The gift card assembly of claim 1, wherein the support backer defines a personalization area including predefined fields for a bearer of the gift card assembly to write who will receive the gift card and who is giving the gift card.

8. The gift card assembly of claim 1, wherein:
- the support backer is formed of a single piece substrate and defines multiple portions, the multiple portions being separated from each other by at least one of a fold line and a perforation line,
- the sticker is coupled only to one of the multiple portions via the panel, and
- the gift card is coupled only to a different one of the multiple portions such that the gift card is readily removable from the different one of the multiple portions.

9. The gift card assembly of claim 8, wherein the multiple portions include a first portion supporting only the sticker, and a second portion supporting only the gift card.

10. The gift card assembly of claim 1, wherein:
- the panel defines a rear, substantially planar surface opposite the sticker,
- the support backer defines a planar surface, and
- the rear, substantially planar surface of the panel is adhered to the planar surface of the support backer.

11. The gift card assembly of claim 1, wherein:
the panel is a first panel,
the sticker is a first sticker, and
the gift card assembly further comprises:
a second panel coupled with the support backer, and
a second sticker coupled with the support backer via the second panel.

12. The gift card assembly of claim 1, wherein:
the gift card defines a first surface,
the activation feature is included on the first surface of the gift card, and
the first surface of the gift card faces and is placed adjacent the support backer.

13. The gift card assembly of claim 12, wherein the support backer defines an opening and the activation feature of the gift card is viewable through the support backer via the opening.

14. A gift card assembly, comprising:
a substrate;
a gift card formed separately from and supported by the substrate, the gift card defining an activation feature configured to facilitate loading the gift card with monetary value; and
a message with a sticky back surface, the message being formed separately from and supported by the substrate;
a page formed separately from the substrate and the gift card, the page supporting the message, wherein the message is coupled to the substrate via the page;
wherein the substrate defines fold lines, and the substrate is configured to be folded about the fold lines to selectively hide one of the gift card and a portion of the sticker from view while allowing full viewing of the other of the gift card and the portion of the sticker.

15. The gift card assembly of claim 14, wherein the portion of the message is all of the message.

16. An apparatus comprising:
a financial transaction card including one of a bar code and a magnetic strip linked to an account stored in a remote database;
one of a sticker and a cling decal;
means for releasably supporting the one of the sticker and the cling decal; and
means for initially coupling the means for releasably supporting the one of the sticker and the cling decal with the financial transaction card, wherein:
the means for initially coupling is formed separately from and supports each of the financial transaction card, the one of the sticker and the cling decal, and the means for releasably supporting,
the means for initially coupling includes one or more fold lines and is configured to fold about the one or more fold lines to substantially entirely enclose the financial transaction card, the plurality of messages, and the means for releasably supporting, and
the means for releasably supporting the plurality of messages fits entirely within a footprint of the means for initially coupling.

17. The apparatus of claim 16, wherein:
the one of the sticker and the cling decal is one of a plurality of one of stickers and cling decals, and
the means for releasably supporting includes at least two sheets each supporting a portion of the plurality of one of stickers and cling decals.

18. The apparatus of claim 16, wherein the means for initially coupling the means for releasably supporting the at one of the sticker and the cling decal with the financial transaction card includes two or more panels separated from one another with one or more of a fold line and a perforation line, wherein the financial transaction card is coupled only with one of the two or more panels, and the means for releasably supporting the at least one of the sticker and the cling decal is coupled only with a different one of the two or more panels.

19. A method of promoting a financial transaction card to a customer, the method comprising:
displaying the financial transaction card to the customer with a sticker, wherein:
the financial transaction card and the sticker are supported by a substrate to collectively form a financial transaction card assembly,
the substrate is formed separately from the financial transaction card and the sticker,
the financial transaction card includes an activation area associated with an account,
the substrate defines an opening, the financial transaction card being positioned on the substrate such that the activation area of the financial transaction card aligns with and is visible through the opening, and
the substrate is initially folded about a fold line such that the opening of the substrate and the activation area of the financial transaction card are not visible; and
loading value to the account using the activation area of the financial transaction card while the financial transaction card is coupled with the substrate, wherein loading value includes rotating the substrate about the fold line to expose the opening and the activation area of the financial transaction card.

20. The method of claim 19, wherein:
the financial transaction card is a stored value card, and
displaying the stored value card occurs at the point-of-sale in a retail sales environment.

21. The method of claim 19, wherein displaying the financial transaction card to a customer includes displaying the sticker coupled to a support panel, which is coupled to the substrate, such that the sticker is coupled to the substrate only via the support panel.

* * * * *